US009200482B2

(12) United States Patent
Steele

(10) Patent No.: US 9,200,482 B2
(45) Date of Patent: Dec. 1, 2015

(54) WELLBORE JUNCTION COMPLETION WITH FLUID LOSS CONTROL

(75) Inventor: David J. Steele, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 945 days.

(21) Appl. No.: 13/275,450

(22) Filed: Oct. 18, 2011

(65) Prior Publication Data

US 2012/0305267 A1 Dec. 6, 2012

Related U.S. Application Data

(63) Continuation-in-part of application No. 13/152,759, filed on Jun. 3, 2011, now Pat. No. 8,967,277.

(51) Int. Cl.

| | |
|---|---|
| ***E21B 34/06*** | (2006.01) |
| ***E03B 3/11*** | (2006.01) |
| ***E21B 28/00*** | (2006.01) |
| ***E21B 7/06*** | (2006.01) |
| ***E21B 41/00*** | (2006.01) |

(52) U.S. Cl.

CPC ..... *E21B 7/061* (2013.01); *E21B 41/0042* (2013.01)

(58) Field of Classification Search

CPC ..... E21B 23/002; E21B 19/16; E21B 34/12; E21B 43/14; E21B 7/061; E21B 41/0042

USPC ..... 166/117.5, 117.6, 242.3, 242.6, 313, 166/50, 373, 380, 316

See application file for complete search history.

(56) References Cited

U.S. PATENT DOCUMENTS

| | | | | |
|---|---|---|---|---|
| 3,871,450 | A | 3/1975 | Jett et al. | |
| 4,913,228 | A | 4/1990 | Setterberg, Jr. | |
| 5,330,007 | A | 7/1994 | Collins et al. | |
| 5,388,648 | A * | 2/1995 | Jordan, Jr. | 166/380 |
| 5,427,177 | A | 6/1995 | Jordan, Jr. et al. | |
| 5,520,252 | A * | 5/1996 | McNair | 166/313 |

(Continued)

FOREIGN PATENT DOCUMENTS

| | | |
|---|---|---|
| RU | 2396657 C1 | 8/2010 |
| SU | 711274 | 1/1980 |

OTHER PUBLICATIONS

International Search Report with Written Opinion issued Nov. 7, 2012 for PCT Patent Application No. PCt/US12/038660, 11 pages.

(Continued)

*Primary Examiner* — Kenneth L Thompson
*Assistant Examiner* — Michael Wills, III
(74) *Attorney, Agent, or Firm* — Chamberlain Hrdlicka

(57) ABSTRACT

A method of installing a wellbore junction assembly in a well can include inserting a tubular string into a deflector, and opening a flow control device in response to the inserting. A well system can include a deflector positioned at an intersection between at least three wellbore sections, and a tubular string connector having at least two tubular strings connected to an end thereof, one tubular string being received in the deflector and engaged with a flow control device positioned in a wellbore section, and another tubular string being received in another wellbore section. Another method of installing a wellbore junction assembly in a well can include inserting a tubular string into a deflector positioned at a wellbore intersection, then sealingly engaging the tubular string, and then opening a flow control device in response to the inserting.

18 Claims, 14 Drawing Sheets

(56) References Cited

U.S. PATENT DOCUMENTS

| | | | | |
|---|---|---|---|---|
| 5,531,270 | A * | 7/1996 | Fletcher et al. | 166/53 |
| 5,560,435 | A | 10/1996 | Sharp | |
| 5,806,614 | A | 9/1998 | Nelson | |
| 5,816,326 | A | 10/1998 | Slater | |
| 5,845,707 | A | 12/1998 | Longbottom | |
| 5,944,109 | A | 8/1999 | Longbottom | |
| 5,960,873 | A | 10/1999 | Alexander et al. | |
| 5,979,560 | A | 11/1999 | Nobileau | |
| 6,003,601 | A * | 12/1999 | Longbottom | 166/313 |
| 6,073,697 | A | 6/2000 | Parlin et al. | |
| 6,079,494 | A * | 6/2000 | Longbottom et al. | 166/313 |
| 6,089,320 | A * | 7/2000 | LaGrange | 166/313 |
| 6,125,937 | A * | 10/2000 | Longbottom et al. | 166/313 |
| 6,142,235 | A | 11/2000 | Monjure et al. | |
| 6,158,513 | A | 12/2000 | Nistor et al. | |
| 6,253,852 | B1 | 7/2001 | Nobileau | |
| 6,390,137 | B1 | 5/2002 | Exald et al. | |
| 6,431,283 | B1 | 8/2002 | Dale | |
| 6,561,277 | B2 | 5/2003 | Algeroy et al. | |
| 6,712,148 | B2 | 3/2004 | Fipke et al. | |
| 6,729,410 | B2 | 5/2004 | Steele | |
| 6,789,628 | B2 | 9/2004 | Hess et al. | |
| 6,907,930 | B2 | 6/2005 | Cavender et al. | |
| 7,219,746 | B2 | 5/2007 | Nobileau | |
| 7,275,598 | B2 | 10/2007 | Steele | |
| 7,299,878 | B2 | 11/2007 | Steele | |
| 7,320,366 | B2 | 1/2008 | Steele et al. | |
| 7,497,264 | B2 | 3/2009 | Moody et al. | |
| 7,513,311 | B2 * | 4/2009 | Gramstad et al. | 166/376 |
| 8,286,708 | B2 * | 10/2012 | Assal et al. | 166/313 |
| 8,376,066 | B2 * | 2/2013 | Steele et al. | 175/61 |
| 2002/0112857 | A1 | 8/2002 | Ohmer et al. | |
| 2002/0121375 | A1 | 9/2002 | Ohmer et al. | |
| 2003/0221834 | A1 | 12/2003 | Hess et al. | |
| 2005/0121190 | A1 | 6/2005 | Oberkircher et al. | |
| 2009/0045368 | A1 | 2/2009 | Cowie et al. | |
| 2010/0319934 | A1 | 12/2010 | Ervin | |
| 2012/0305266 | A1 | 12/2012 | Steele et al. | |
| 2012/0305267 | A1 | 12/2012 | Steele | |
| 2012/0305268 | A1 | 12/2012 | Steele | |

OTHER PUBLICATIONS

Halliburton Drawing No. 12MLE1106, size D, title 4 1/2 Direct Pressure Shear Disc Sub, designed by David Steele, dated Jul. 27, 2000, 1 page.

Baker Hughes; "Sand Control Systems", product information, dated 2010, 174 pages.

Halliburton; "FS2 Fluid Loss Isolation Barrier Valve", product article, received Sep. 26, 2011, 2 pages.

Halliburton; "Tibing Control Valve", Attorney Client Privilege Communication, dated Mar. 14, 2011, 2 pages.

Halliburton; "IB Series Mechanical Fluid Loss Isolation Barrier Valve", H06472, dated Sep. 2010, 2 pages.

Halliburton; "Isolation Barrier Valves", H07542, dated Jun. 2010, 4 pages.

Halliburton; "Perforating Solutions", received Dec. 2, 2011, 217 pages.

Halliburton; "Magnumdisk Single and Dual Ceramic Disk Assemblies—Universal", Basic Design and Maintenance Instructions, dated Nov. 17, 2006, 19 pages.

Halliburton; "LA0 Liquid Spring-Actuated Anvil Plugging System", product article, received Sep. 26, 2011, 2 pages.

Magnum Oil Tools; "TCP Systems", product manual and information, received Aug. 14, 2011, 23 pages.

Magnum Oil Tools; "Magnumdisk", product manual and information, received Sep. 26, 2011, 10 pages.

Magnum Oil Tools; "Dual Magnumdisk: Frangible Knockout Isolation Sub", Online product article, dated 2001, 1 page.

Shlumberger; "Fortress: Isolation Valve", product information, dated 2011, 2 pages.

Shlumberger; "Fortress: Isolation Valve", product brochure, dated 2011, 3 pages.

Office Action issued 40 Apr. 2013 for U.S. Appl. No. 13/152,759, 30 pages.

Office Action issued Mar. 13, 2014 for U.S. Appl. No. 13/152,759, 19 pages.

Office Action issued Apr. 11, 2014 for U.S. Appl. No. 13/781,570, 30 pages.

International Search Report and Written Opinion issued Dec. 21, 2012 for PCT Patent Application No. PCT/US2012/038671, 9 pages.

U.S. Appl. No. 13/152,892, filed Jun. 3, 2011, 18 pages.

Drawings for U.S. Appl. No. 13/152,892, 1 page.

Dresser Industries, Inc.; "P-Tubing Control Valve", injection valve assembly model, drawing 94417, dated Aug. 11, 2003, 1 page.

American Oil & Gas Reporter; "Tubulars Technology: New Tubular and Connections Capabilities Overcome Downhole Challenges", newspaper article, dated Sep. 2005, 5 pages.

Halliburton; "Mirage Disappearing Plug and Autofill Sub", H00093, dated Jun. 2010, 2 pages.

Halliburton; "SperryRite Advanced Reservoir Drainage Services", H02576, Sep. 2007, 2 pages.

Halliburton; "ReFlexRite Milled Exit Isolated Tie-Back Multilateral System", H05737, Jun. 2009, 2 pages.

Halliburton; "DP1 Anvil Plugging System", H06466, dated Sep. 2008, 2 pages.

Halliburton; "Advanced Reservoir Drainage Solutions: Two Production Wells in Different Pressured Reservoirs Receive High-Pressure Water Injection from Multilateral Well", H06600, dated Jun. 2009, 2 pages.

Halliburton; "SperryRite Multilateral Systems", H07438, Jan. 2010, 15 pages.

Vallourec 7 Mannesmann Tubes; "VAM-FJL: No Gamble with the Royal Flush", created prior to May 18, 2011, 3 pages.

Baker Hughes; "Case Hole Applications", product and systems catalog, dated 2010, 94 pages.

Collins, Gary; Bennett, Rod; "Two Wells Drilled From One Surface Bore with Downhole Splitter. (Oil Well Drilling Technology)", The Oil and Gas Journal, online article from accessmylibrary.com, dated Oct. 3, 1994, 5 pages.

Boggs, Robert N.; "Splitter Puts Two Wells in One Wellhead", DesignNews Blog, dated Mar. 27, 1995, 1 page.

Halliburton; "Developing the Heavy Oil and Oil Sands Assets", article H06153, dated Mar. 2008, 46 pages.

Perdue, Jeanne M.; "Level 5 and 6 Junctions Really Function", E&P magazine online article, dated May 1, 2001, 3 pages.

Halliburton; "SperryRite Advanced Reservoir Drainage Services: FloRite Multi-string Multilateral Completion System Multilateral Completion Systems", article H02583-A4, dated Sep. 2007, 2 pages.

Halliburton; "Multilateral Solutions: SperryRite Advanced Reservoir Drainage Services", product article, retrieved Jul. 20, 2011, 6 pages.

Schlumberger; "RapidX: TAML 5 Multilateral Junction", product sheet, dated 2009, 2 pages.

Schlumberger; "RapidX: TAML 5 Multilateral Junction", online product page, dated 2009, 1 page.

Halliburton; "SperryRite Advanced Reservoir Drainage Services", article H06637, dated Jan. 2009, 2 pages.

Fischer, Perry A. et al; Expandable Technology Developments Zero in on Practical Applications; World Oil Online; vol. 226 No. 7; Retrieved on Aug. 2, 2011 from http//www.worldoil.com/July-2005-Expandable-technology-developments-zero-in-on-practical-applications.html; 11 pages.

Erivwo, Ochuko et al; Level 6 Multi-Lateral Experiences in the Niger Delta—A Review; SPE 90423; Sep. 2004; 13 pages.

W. Standifird, et al; "Real-Time Basin Modeling: Improving Geopressure and Easrth-Stress Predictions", SPE96464, Sep. 6-9, 2005, 6 pages.

W. Standifird, et al; "New Data Transmission Standard Facilitates Synchronous Remote Modeling and Surveillance via the Internet", SPE99466, Apr. 11-13, 2006, 9 pages.

Jones, John, et al; "Novel Approach for Estimating Pore Fluid Pressures Ahead of the Drill Bit", SPE 104606, Feb. 20-22, 2007, 13 pages.

(56) References Cited

OTHER PUBLICATIONS

Office Action issued Oct. 18, 2013 for U.S. Appl. No. 13/152,759, 18 pages.
Office Action issued Oct. 3, 2013 for U.S. Appl. No. 13/781,570, 23 pages.
English Abstract of patent RU 2396657, 2 pgs.
English Abstract of patent SU 711274, 2 pgs.
English translation of Office Action issued in corresponding application No. RU 2013158316, dated Feb. 18, 2015, 4 pgs.
English translation of Office Action issued in corresponding application No. RU 2013158398, dated Mar. 10, 2015, 2 pgs.

* cited by examiner

WELLBORE JUNCTION COMPLETION WITH FLUID LOSS CONTROL

CROSS-REFERENCE TO RELATED APPLICATION

This application is a continuation-in-part of prior application Ser. No. 13/152,759, filed on 3 Jun. 2011. The entire disclosure of the prior application is incorporated herein by this reference.

BACKGROUND

This disclosure relates generally to equipment utilized and operations performed in conjunction with a subterranean well and, in an example described below, more particularly provides a wellbore junction completion with fluid loss control.

A wellbore junction provides for connectivity in a branched or multilateral wellbore. Such connectivity can include sealed fluid communication and/or access between certain wellbore sections.

Unfortunately, a typical wellbore junction completion does not provide for fluid loss control. Therefore, it will be appreciated that improvements would be beneficial in the art of configuring wellbore junction completions.

SUMMARY

In the disclosure below, apparatus and methods are provided which bring improvements to the art of configuring wellbore junction assemblies. One example is described below in which a wellbore junction assembly includes a tubular string which is received in a deflector, and opens a flow control device. Another example is described below in which the flow control device isolates sections of a wellbore from each other, until the tubular string is installed.

In one aspect, the disclosure below describes a method of installing a wellbore junction assembly in a well. In one example, the method can include inserting a tubular string into a deflector, and opening a flow control device in response to the inserting.

In another aspect, this disclosure provides to the art a well system. In one example, the well system can include a deflector positioned at an intersection between at least three wellbore sections, and a tubular string connector having at least two tubular strings connected to an end thereof, one tubular string being received in the deflector and engaged with a flow control device positioned in a wellbore section, and another tubular string being received in another wellbore section.

In yet another aspect, a method of installing a wellbore junction assembly in a well is described below. In one example, the method can include inserting a tubular string into a deflector positioned at a wellbore intersection, then sealingly engaging the tubular string, and then opening a flow control device in response to the inserting.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
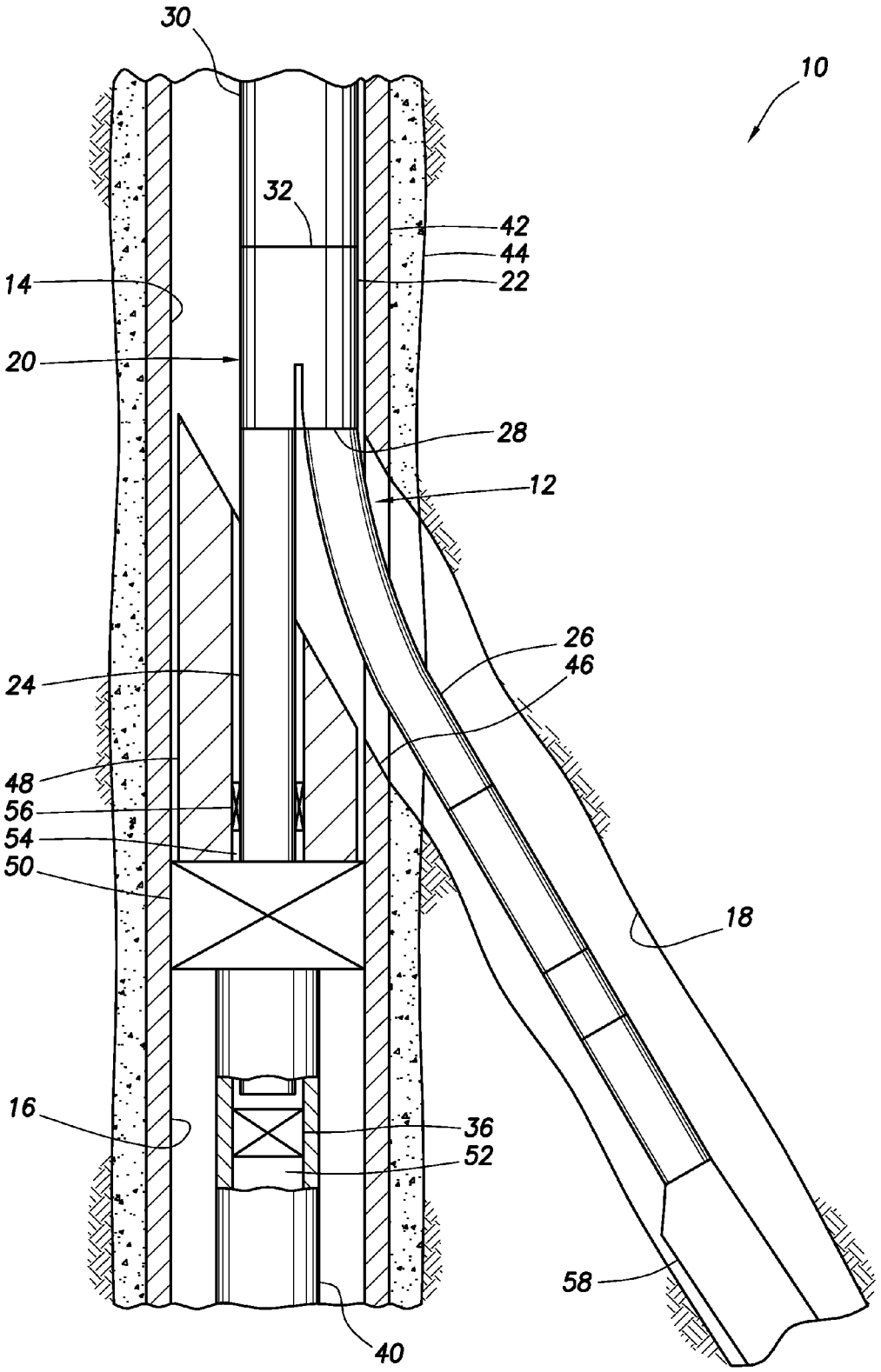
FIG. 1 is a representative partially cross-sectional view of a well system and associated method which can embody principles of this disclosure.

Representatively illustrated in FIG. 1 is a well system 10 and associated method which can embody principles of this disclosure. In the well system 10, a wellbore junction 12 is formed at an intersection of three wellbore sections 14, 16, 18.

In this example, the wellbore sections 14, 16 are part of a "parent" or main wellbore, and the wellbore section 18 is part of a "lateral" or branch wellbore extending outwardly from the main wellbore. In other examples, the wellbore sections 14, 18 could form a main wellbore, and the wellbore section 16 could be a branch wellbore. In further examples, more than three wellbore sections could intersect at the wellbore junction 12, the wellbore sections 16, 18 could both be branches of the wellbore section 14, etc. Thus, it should be understood that the principles of this disclosure are not limited at all to the particular configuration of the well system 10 and wellbore junction 12 depicted in FIG. 1 and described herein.

In one feature of the well system 10, a wellbore junction assembly 20 is installed in the wellbore sections 14, 16, 18 to provide controlled fluid communication and access between the wellbore sections. The assembly 20 includes a tubular string connector 22, tubular strings 24, 26 attached to an end 28 of the connector, and a tubular string 30 attached to an opposite end 32 of the connector.

In this example, the connector 22 provides sealed fluid communication between the tubular string 30 and each of the tubular strings 24, 26. In addition, physical access is provided through the connector 22 between the tubular string 30 and at least one of the tubular strings 24, 26.

A valve or other flow control device 36 controls flow longitudinally through a tubular string 40 in the wellbore section 16. In this example, it is desired to maintain the flow control device 36 closed until the junction assembly 20 is installed at the wellbore junction 12, in order to prevent loss of fluid into an earth formation penetrated by the wellbore, to prevent fluid from flowing to the surface from the formation below the valve (e.g., to prevent a "kick" or fluid influx) and/or to prevent pressure above the valve from being applied to the formation below the valve, etc.

In the example depicted in FIG. 1, the wellbore sections 14, 16 are lined with casing 42 and cement 44, but the wellbore section 18 is uncased or open hole. A window 46 is formed through the casing 42 and cement 44, with the wellbore section 18 extending outwardly from the window.

However, other completion methods and configurations may be used, if desired. For example, the wellbore section 18 could be lined, with a liner therein being sealingly connected to the window 46 or other portion of the casing 42, etc. Thus, it will be appreciated that the scope of this disclosure is not limited to any of the features of the well system 10 or the associated method described herein or depicted in the drawings.

A deflector 48 is secured in the casing 42 at the junction 12 by a packer, latch or other anchor 50. The tubular string 40 is sealingly secured to the anchor 50 and deflector 48, so that a passage 52 in the tubular string 40 is in communication with a passage 54 in the deflector 48 when the flow control device 36 is open. The flow control device 36 may be closed, for example, after setting the packer 50 in the wellbore portion 16. The tubular string 24 is thereafter engaged with seals 56 in the deflector 48, so that the tubular string 24 is in sealed communication with the tubular string 40 in the wellbore section 16.

A bull nose 58 on a lower end of the tubular string 26 is too large to fit into the passage 54 in the deflector 48 and so, when the junction assembly 20 is lowered into the well, the bull nose 58 is deflected laterally into the wellbore section 18. The tubular string 24, however, is able to fit into the passage 54 and, when the junction assembly 20 is appropriately positioned as depicted in FIG. 1, and the flow control device 36 is opened, the tubular string 24 will be in sealed communication with the tubular string 40 via the passage 52.

In the example of FIG. 1, fluids (such as hydrocarbon fluids, oil, gas, water, steam, etc.) can be produced from the wellbore sections 16, 18 via the respective tubular strings 24, 26. The fluids can flow via the connector 22 into the tubular string 30 for eventual production to the surface.

However, such production is not necessary in keeping with the scope of this disclosure. In other examples, fluid (such as steam, liquid water, gas, etc.) could be injected into one of the wellbore sections 16, 18 and another fluid (such as oil and/or gas, etc.) could be produced from the other wellbore section, fluids could be injected into both of the wellbore sections 16, 18, etc. Thus, any type of injection and/or production operations can be performed in keeping with the principles of this disclosure.

Figure 2:
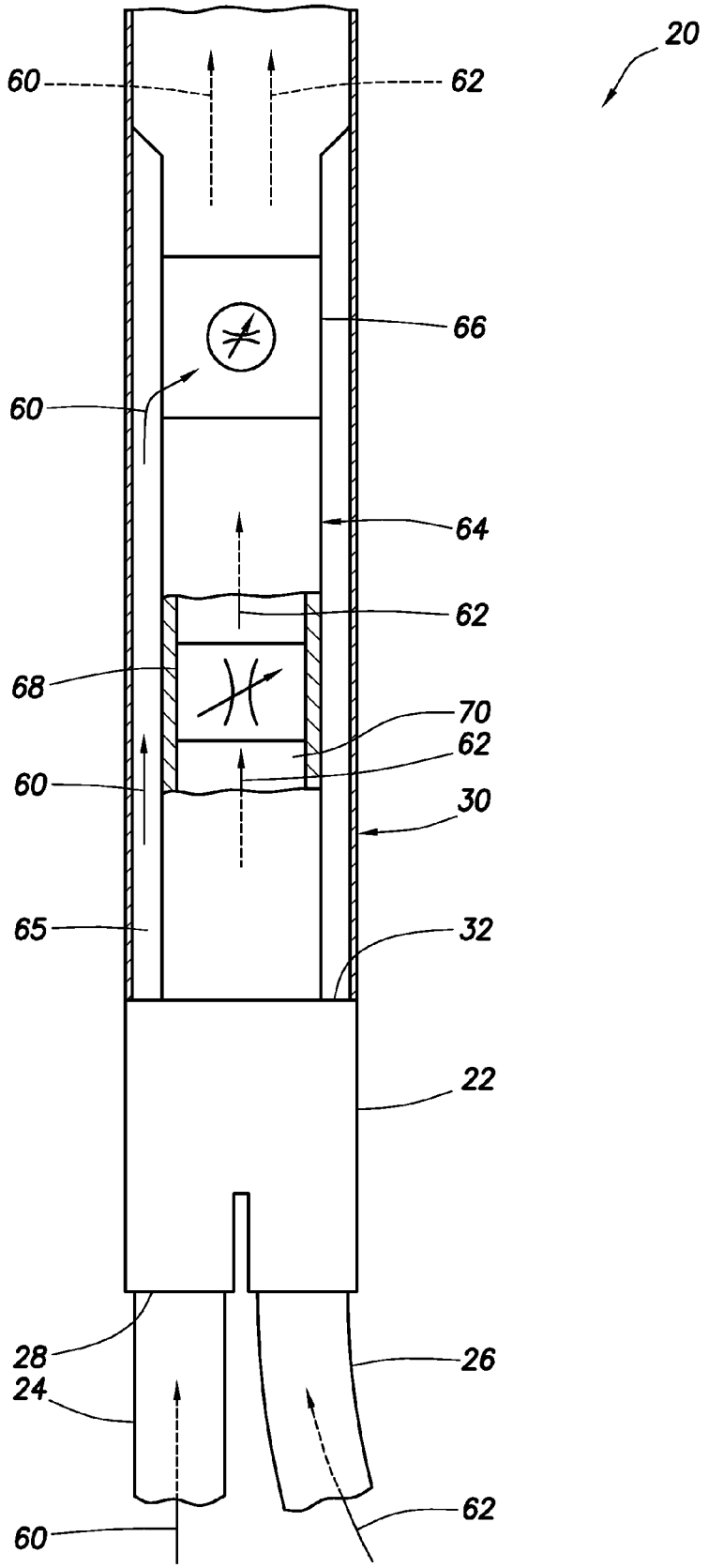
FIG. 2 is a representative partially cross-sectional view of a wellbore junction assembly which may be used in the system and method of FIG. 1.
Figure 3A:
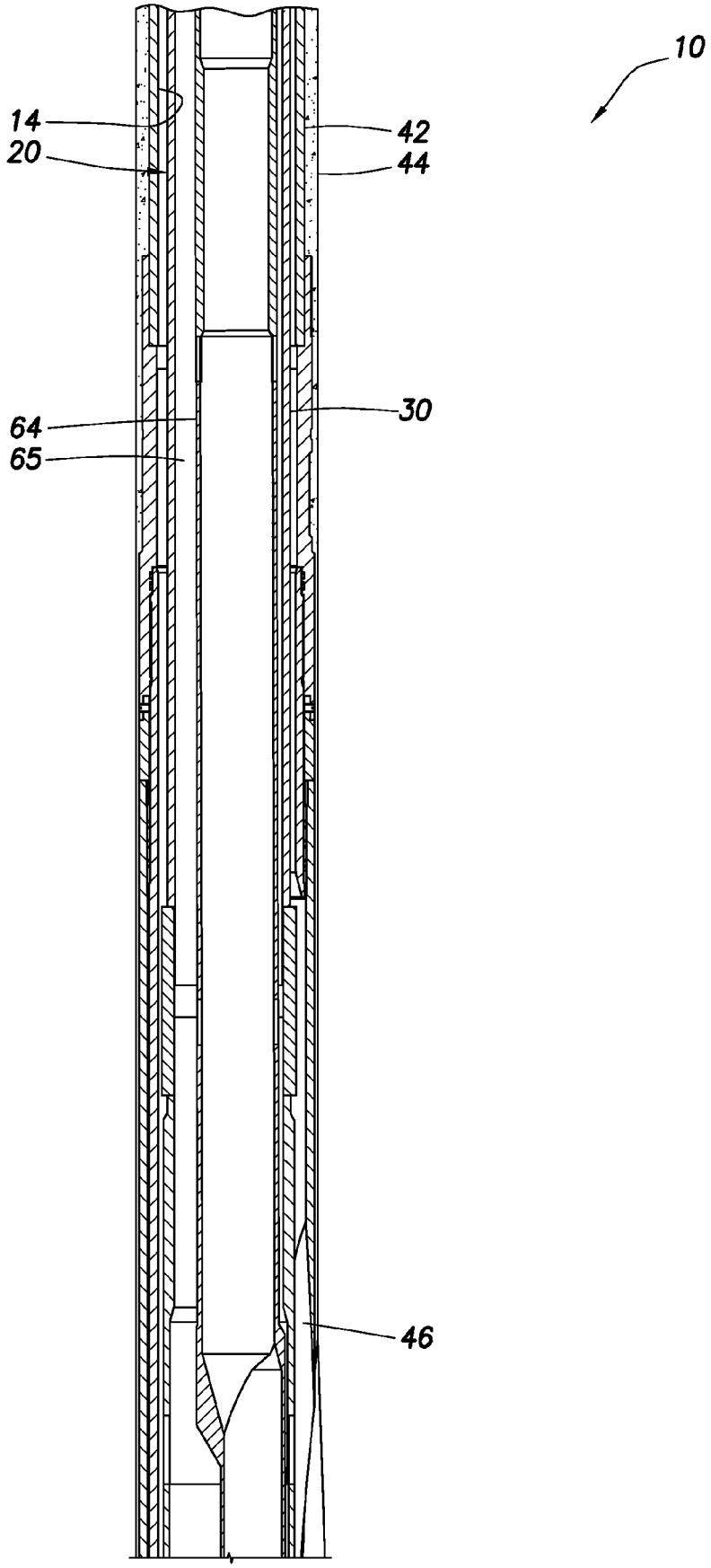
FIG. 3A-E are representative cross-sectional detailed views of the wellbore junction assembly installed in a branched wellbore.
Figure 3B:
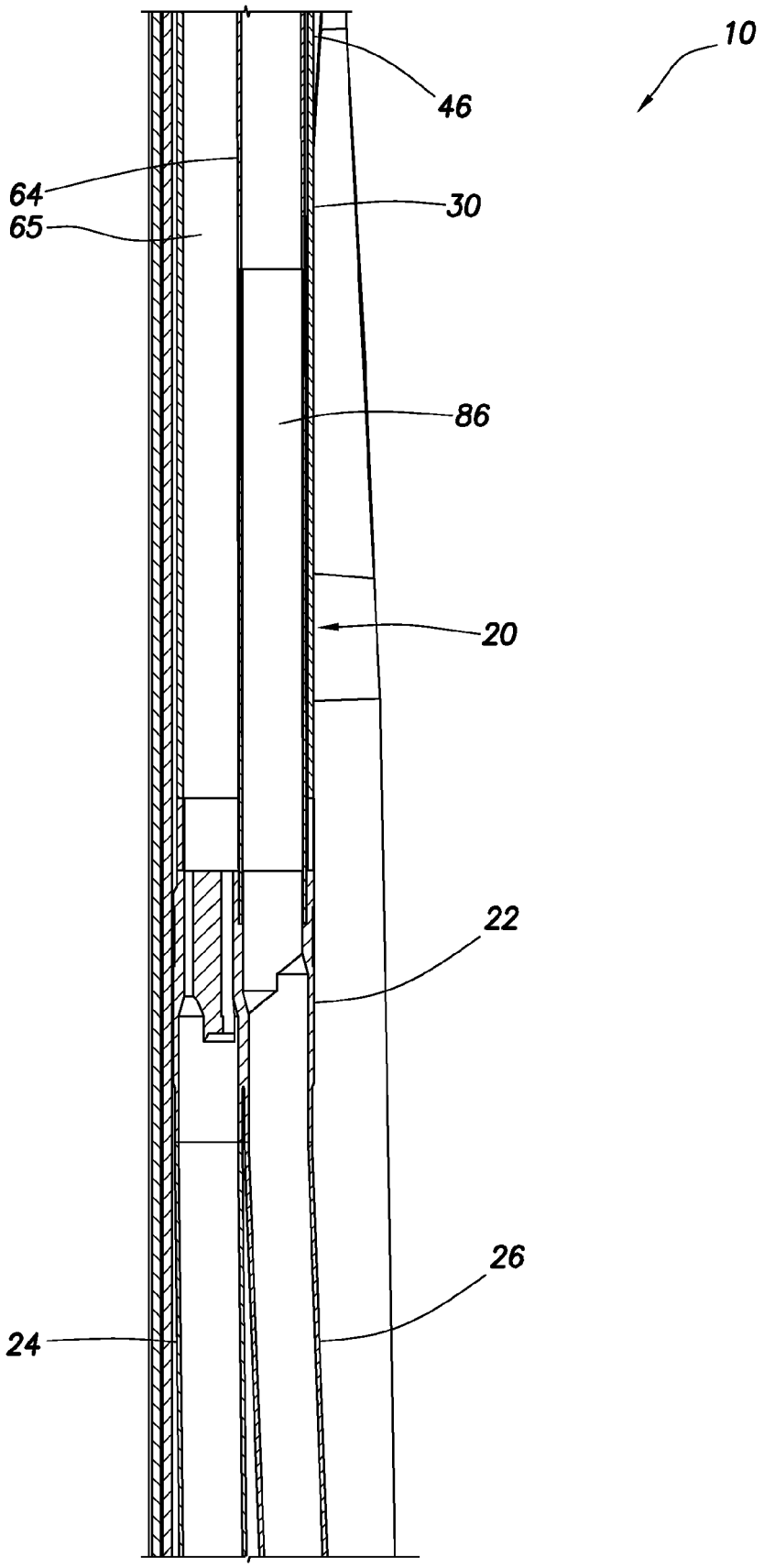
Figure 3C:
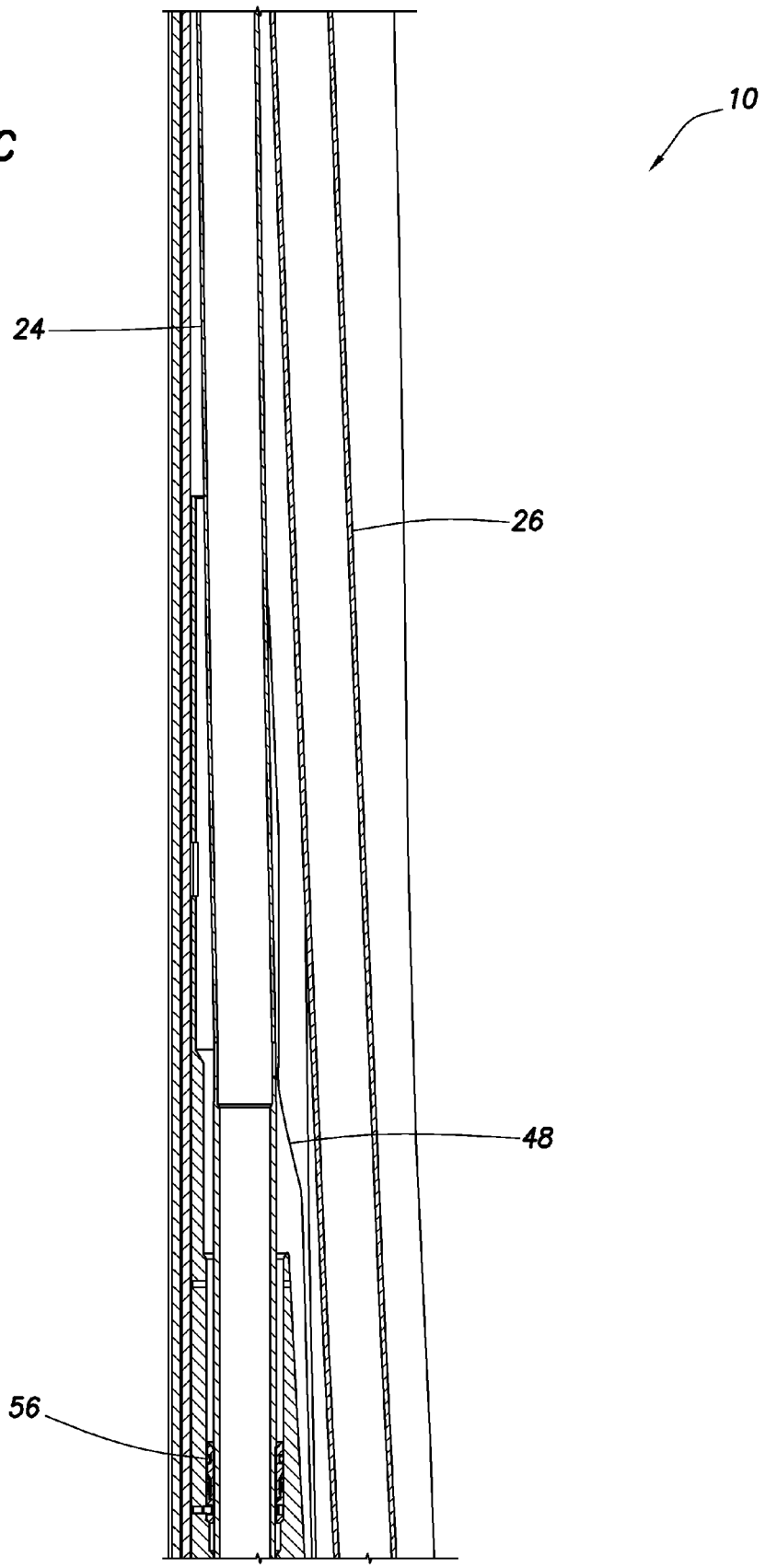
Figure 3D:
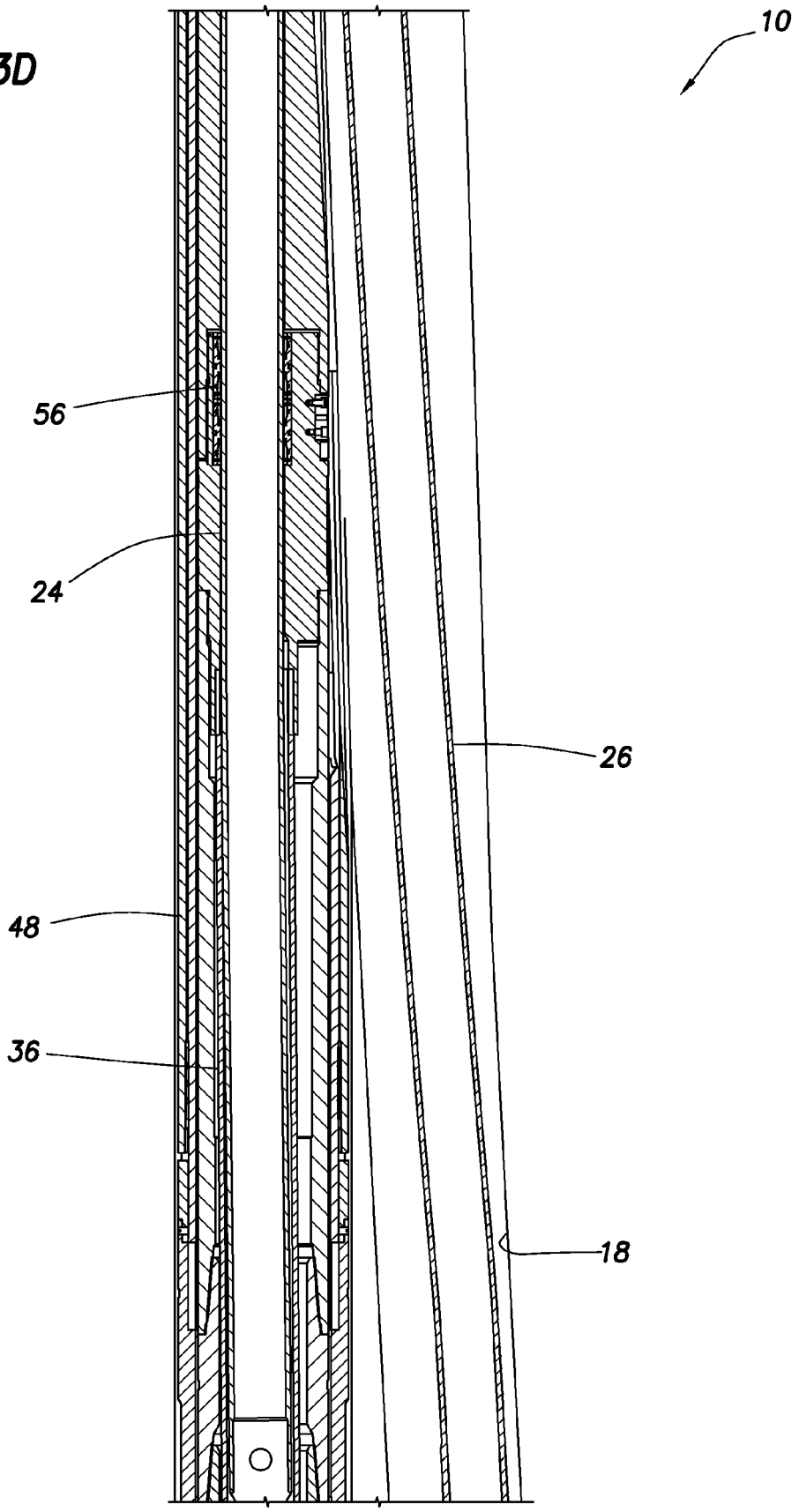
Figure 3E:
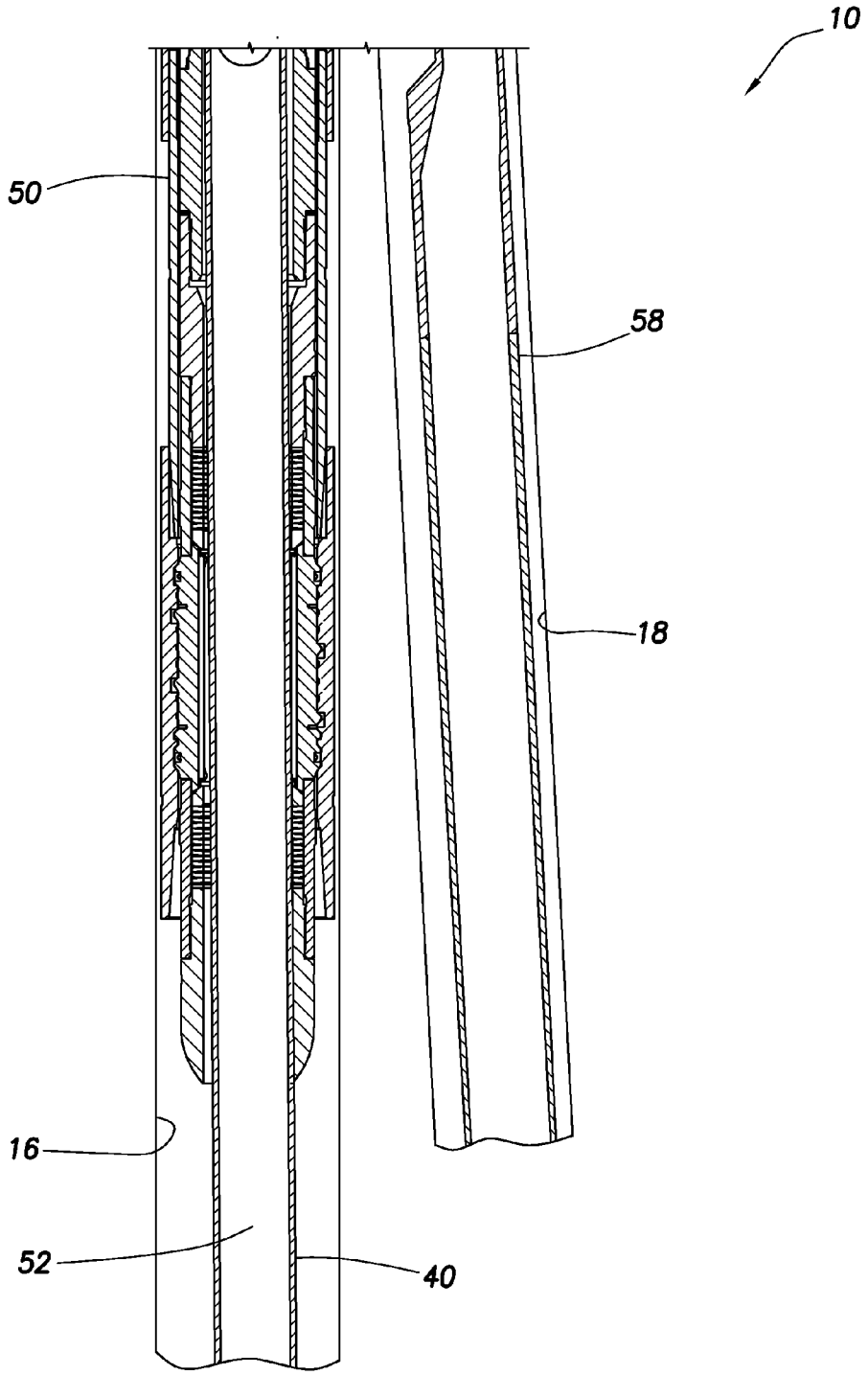

Referring additionally now to FIG. 2, a partially cross-sectional view of the wellbore junction assembly 20 is representatively illustrated, apart from the remainder of the system 10. In this example, a fluid 60 is produced from the wellbore section 16 via the tubular string 24 to the connector 22, and another fluid 62 is produced from the wellbore section 18 via the tubular string 26 to the connector. The fluids 60, 62 may be the same type of fluid (e.g., oil, gas, steam, water, etc.), or they may be different types of fluids.

The fluid 62 flows via the connector 22 into another tubular string 64 positioned within the tubular string 30. The fluid 60 flows via the connector 22 into a space 65 formed radially between the tubular strings 30, 64.

Chokes or other types of flow control devices 66, 68 can be used to variably regulate the flows of the fluids 60, 62 into the tubular string 30 above the tubular string 64. The devices 66, 68 may be remotely controllable by direct, wired or wireless means (e.g., by acoustic, pressure pulse or electromagnetic telemetry, by optical waveguide, electrical conductor or control lines, mechanically, hydraulically, etc.), allowing for an intelligent completion in which production from the various wellbore sections can be independently controlled.

Although the fluids 60, 62 are depicted in FIG. 2 as being commingled in the tubular string 30 above the tubular string 64, it will be appreciated that the fluids could remain segregated in other examples. In addition, although the device 68 is illustrated as possibly obstructing a passage 70 through the tubular string 64, in other examples the device 68 could be positioned so that it effectively regulates flow of the fluid 62 without obstructing the passage.

Referring additionally now to FIGS. 3A-E, detailed cross-sectional views of the junction assembly 20 as installed in the wellbore sections 14, 16, 18 of the well system 10 are representatively illustrated. For clarity, the remainder of the well system 10 is not illustrated in FIGS. 3A-E.

In FIGS. 3A-E, it may be clearly seen how the features of the junction assembly 20 cooperate to provide for a convenient and effective installation in the wellbore sections 14, 16, 18. Note that the tubular string 26 has been deflected by the deflector 48 into the wellbore section 18, the tubular string 24 is sealingly received in the seals 56, and the flow control device 36 has been opened in response to inserting the tubular string 24 into the passages 52, 54. Fluid communication is now established between the connector 22 (and the tubular string 30 thereabove) and each of the tubular strings 24, 26.

Preferably, the tubular string 24 is sealingly engaged with the seals 56 prior to the flow control device 36 being opened. In this manner, sealed fluid communication is established between the tubular string 24 and the passage 54 prior to opening the flow control device 36, thereby enhancing continued control over pressure and flow communicated to the passage 52 (and formations penetrated below the wellbore section 16) when the flow control device is opened.

The flow control device 36 may be opened using a variety of different techniques, some of which are described below. However, the scope of this disclosure is not limited to the particular techniques for opening the various examples of the flow control device 36 described below, since any method of opening the flow control device may be used in keeping with the scope of this disclosure.

Preferably, the flow control device 36 opens in response to the tubular string 24 being inserted into the passages 52, 54. As mentioned above, the flow control device 36 is also preferably opened after the tubular string 24 is sealingly engaged with the seals 56.

Figure 4:
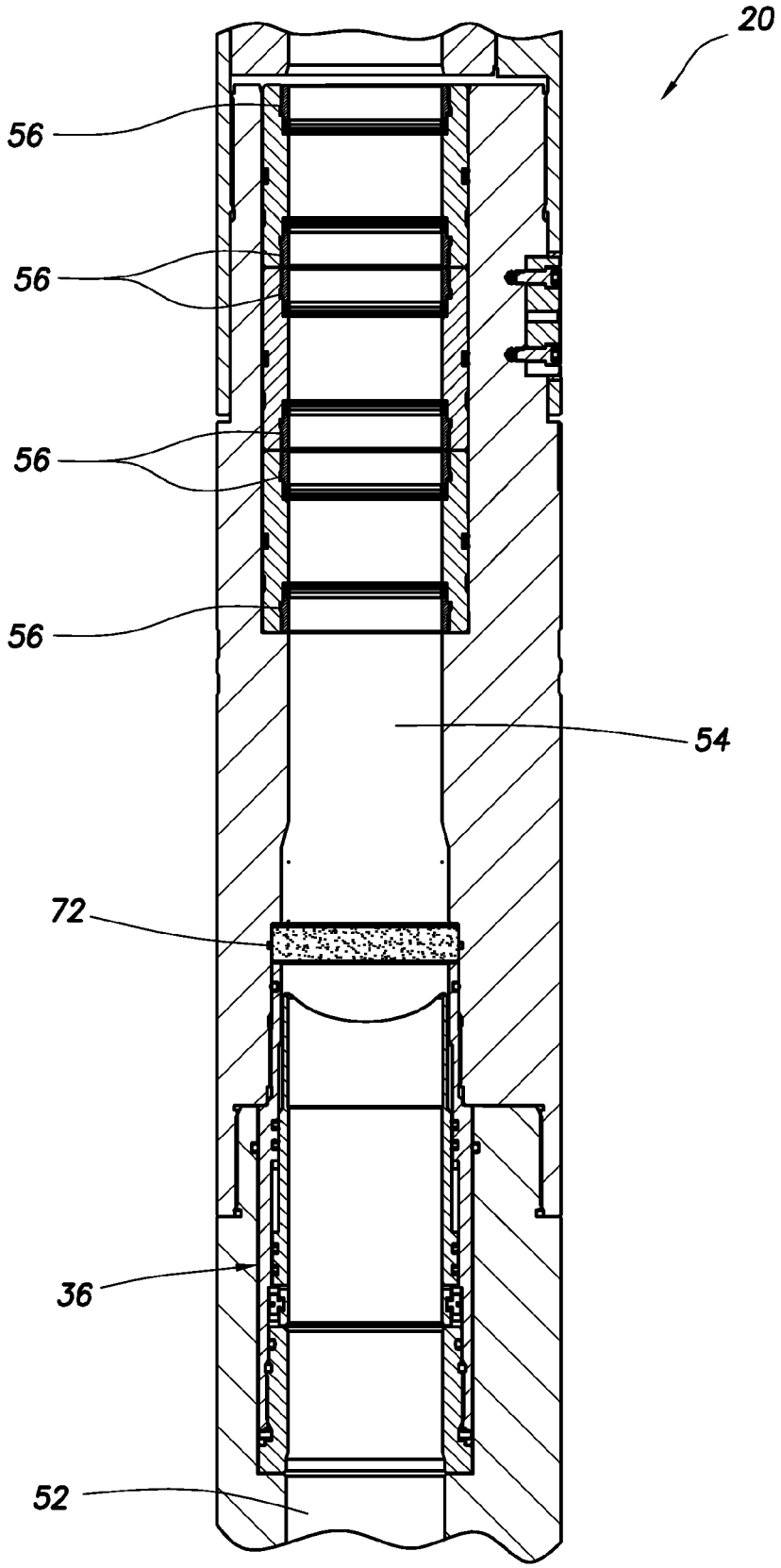
FIG. 4 is a representative cross-sectional view of a portion of the junction assembly including a flow control device.

Referring additionally now to FIG. 4, an enlarged scale cross-sectional view of a section of the junction assembly 20 is representatively illustrated apart from the remainder of the well system 10. In this example, the flow control device 36 is positioned just below the seals 56, so that, when the tubular string 24 is inserted into the passage 54, the tubular string will engage the seals 56 just prior to engaging the flow control device.

The flow control device 36 is similar in some respects to a Glass Disc Sub (Model DP-SDS) marketed by Halliburton Energy Services, Inc. of Houston, Tex. USA. The flow control device 36 includes a frangible barrier 72 (such as glass or ceramic, etc.) which initially prevents fluid communication between the passages 52, 54. When the barrier 72 is broken, fluid communication is permitted between the passages 52, 54.

Figure 5:
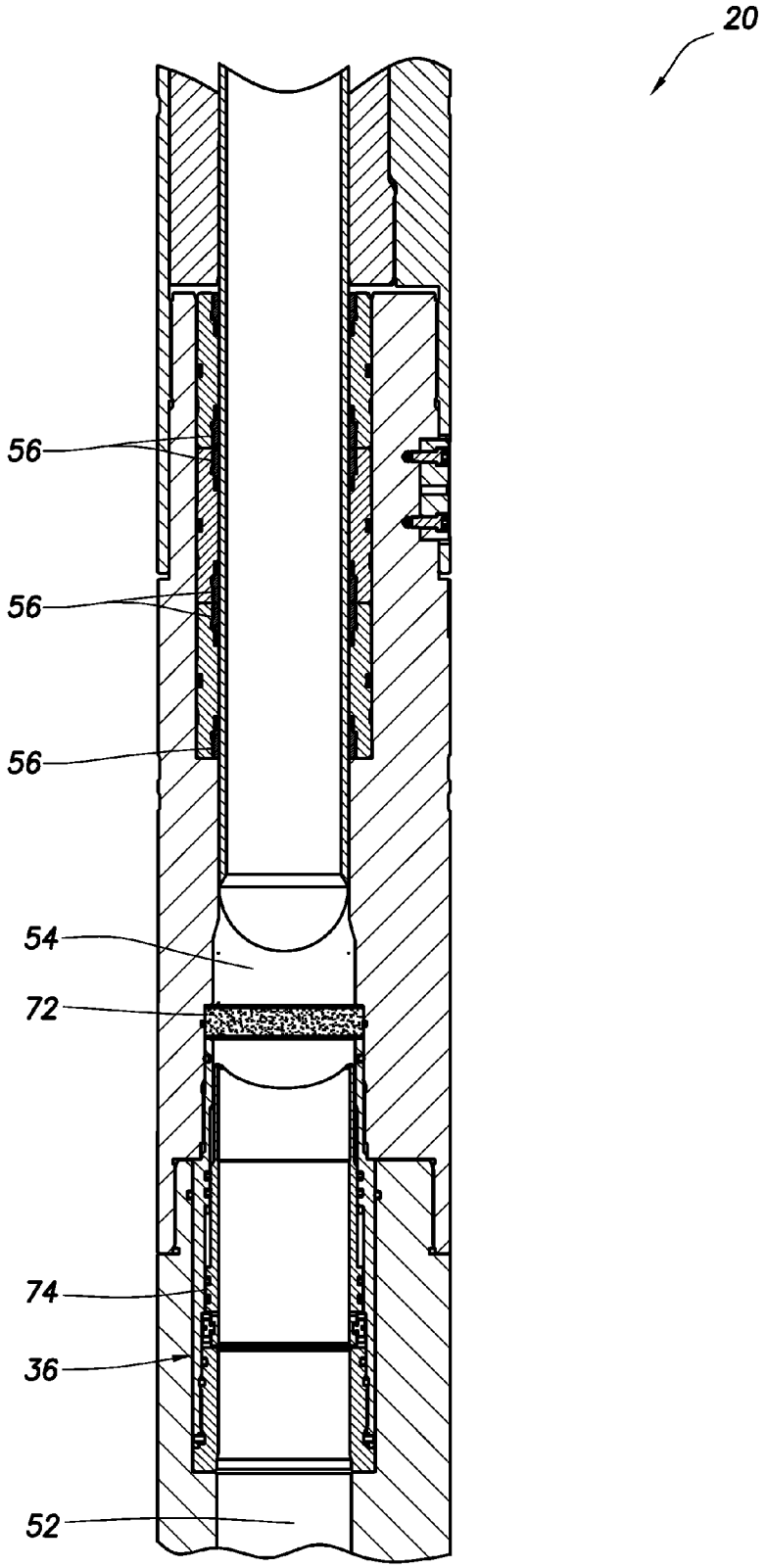
FIG. 5 is a representative cross-sectional view of the junction assembly, with the flow control device being opened by insertion of a tubular string therein.

At least two ways of breaking the barrier 72 are provided. The tubular string 24 can break the barrier 72 when the tubular string is inserted into the passage 54 (as depicted in FIG. 5), or increased pressure in the passage 52 below the flow control device 36 can displace an annular piston 74 to impact the barrier from below.

Increased pressure in the passage 52 below the flow control device 36 could be due to stinging the deflector 48 into the anchor 50. In that case, the barrier 72 could be broken due to the increased pressure, prior to inserting the tubular string 24 into the passage 54.

In another example, the device 36 could be operated by applying pressure to a control line or port in communication with a chamber (not shown) exposed to a piston (see FIG. 4)

of the device. The piston would then displace when pressure in the chamber is increased sufficiently to break shear pins/screws, or another type of releasing device, in order to break the barrier 72.

In yet another example, the device 36 could be turned upside-down, so that the piston of the device is exposed to pressure in the passage 54 above the barrier 72. In this example, increased pressure applied to the passage 54 will cause the piston to displace, in order to break the barrier 72.

In a further example, pressure applied to the tubular string 24 can be used to apply pressure to the passage 54 (or to another passage, such as a passage extending through a sidewall of the deflector 48, etc.), in order to displace the piston of the device 36 and break the barrier 72.

Figure 6:
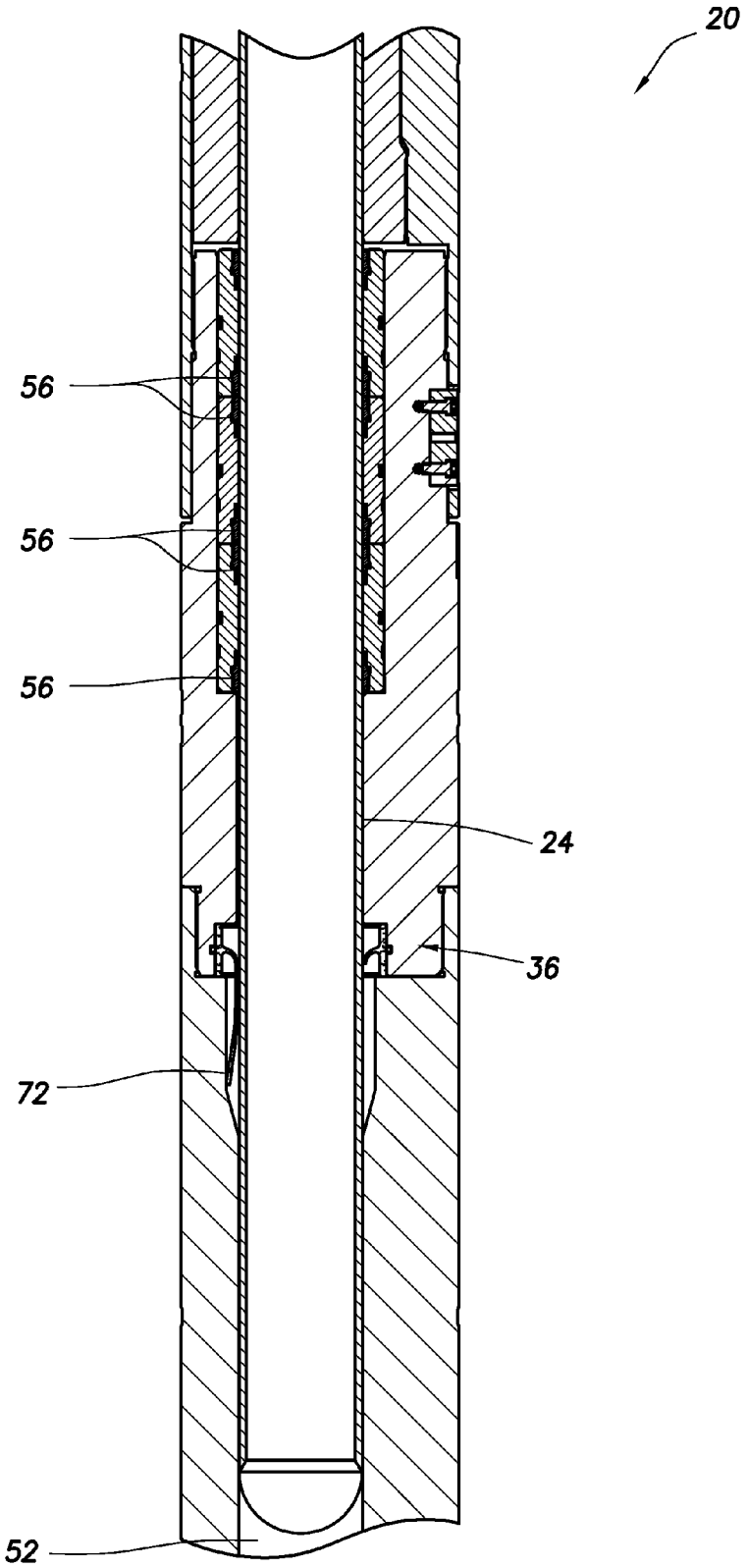
FIG. 6 is a representative cross-sectional view of the junction assembly with another flow control device being opened therein.

Referring additionally now to FIG. 6, another configuration of the junction assembly 20 is representatively illustrated. In this configuration, the barrier 72 is pierced by the tubular string 24 when it is inserted into the passage 52.

The barrier 72 in this example is preferably a severable metal disc, similar to that used in an ANVIL™ plugging system marketed by Halliburton Energy Services, Inc. The barrier 72 is preferably cut by a lower end of the tubular string 24, and folded out of the way, so that the tubular string can extend through it into the passage 52.

Figure 7:
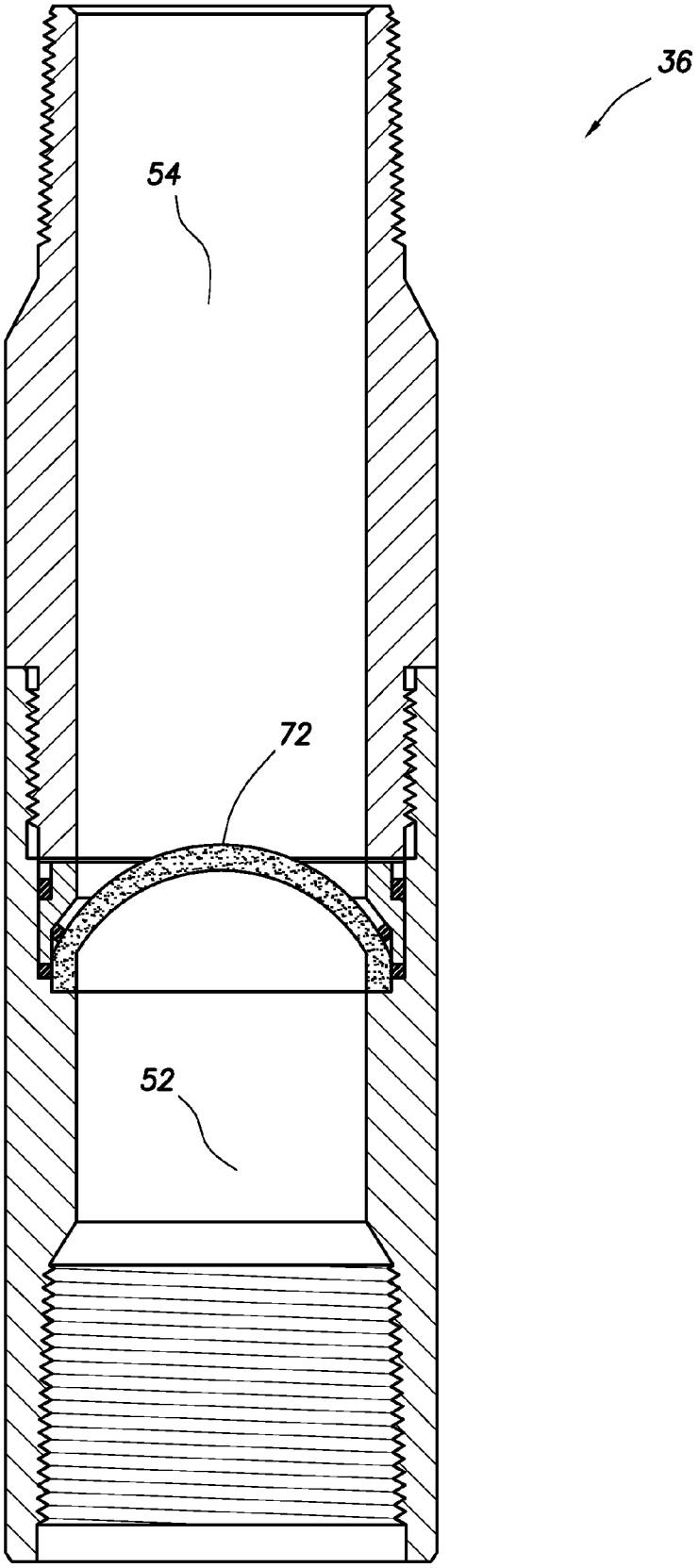
FIGS. 7-10 are representative cross-sectional views of additional configurations of the flow control device.

Referring additionally now to FIG. 7, another example of the flow control device 36 is representatively illustrated, apart from the remainder of the junction assembly 20. In this example, the barrier 72 is generally hemispherical in shape, and is preferably made of a ceramic material, so that the barrier is frangible.

The curved shape of the barrier 72 enables it to withstand a substantial pressure differential from the passage 54 to the passage 52. In addition, the barrier 72 can be readily broken by the tubular string 24 when it is inserted into the passages 52, 54.

Figure 8:
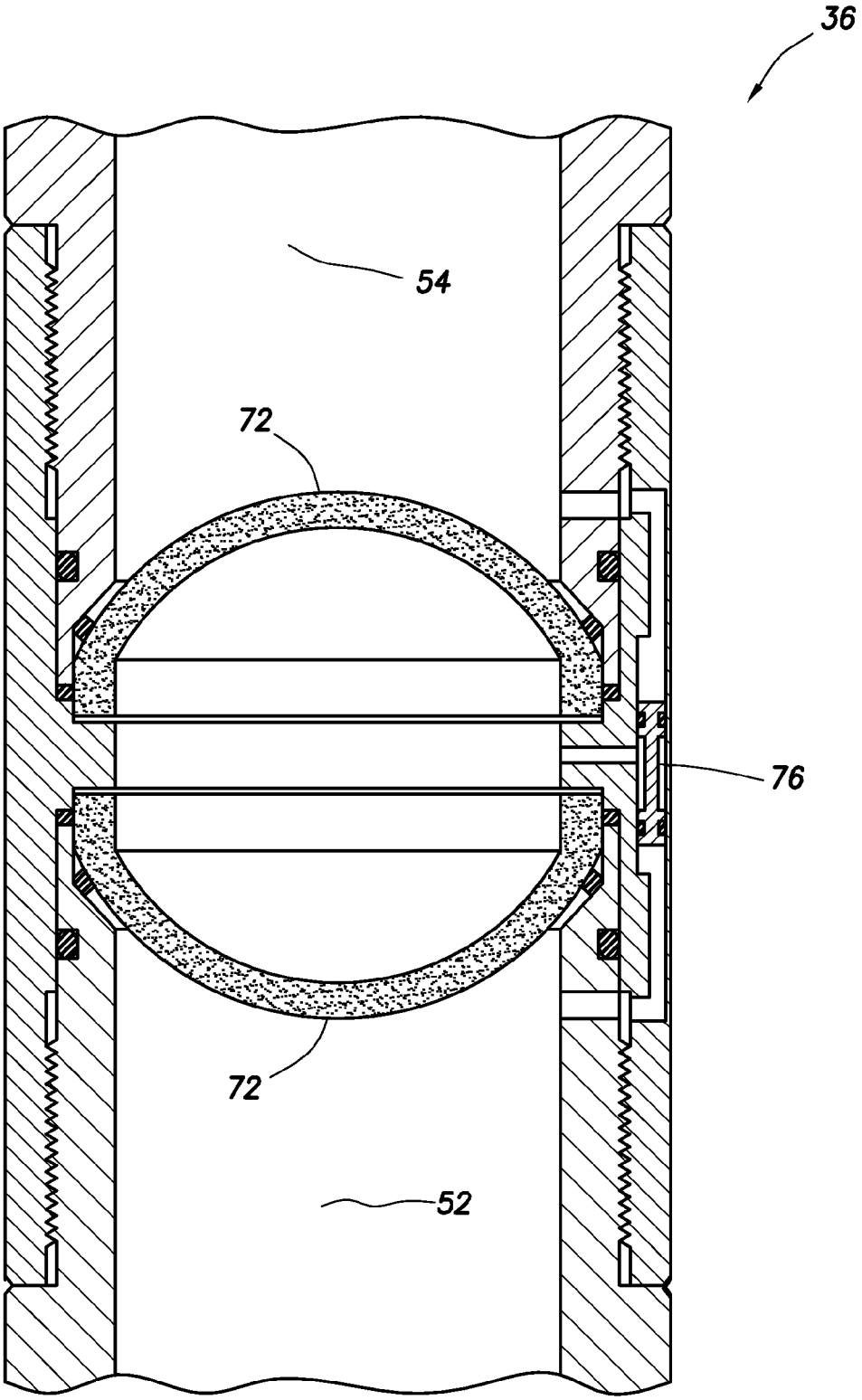

Referring additionally now to FIG. 8, a portion of another configuration of the flow control device 36 is representatively illustrated. In this configuration, two oppositely facing barriers 72 are used, so that the barriers can withstand substantial pressure differentials from both longitudinal directions (e.g., from the passage 52 to the passage 54, and from the passage 54 to the passage 52).

The barriers 72 in the FIGS. 7 & 8 configurations may be similar to the MAGNUMDISK™ marketed by Magnum Oil Tools of Corpus Christi, Tex. USA. In the FIG. 8 configuration, a pressure equalizing device 76 may be used to prevent trapping atmospheric pressure between the barriers 72. The device 76 equalizes pressure in the space between the barriers 72 with the passage 52 or 54 having the greatest pressure at any given time.

Figure 9:
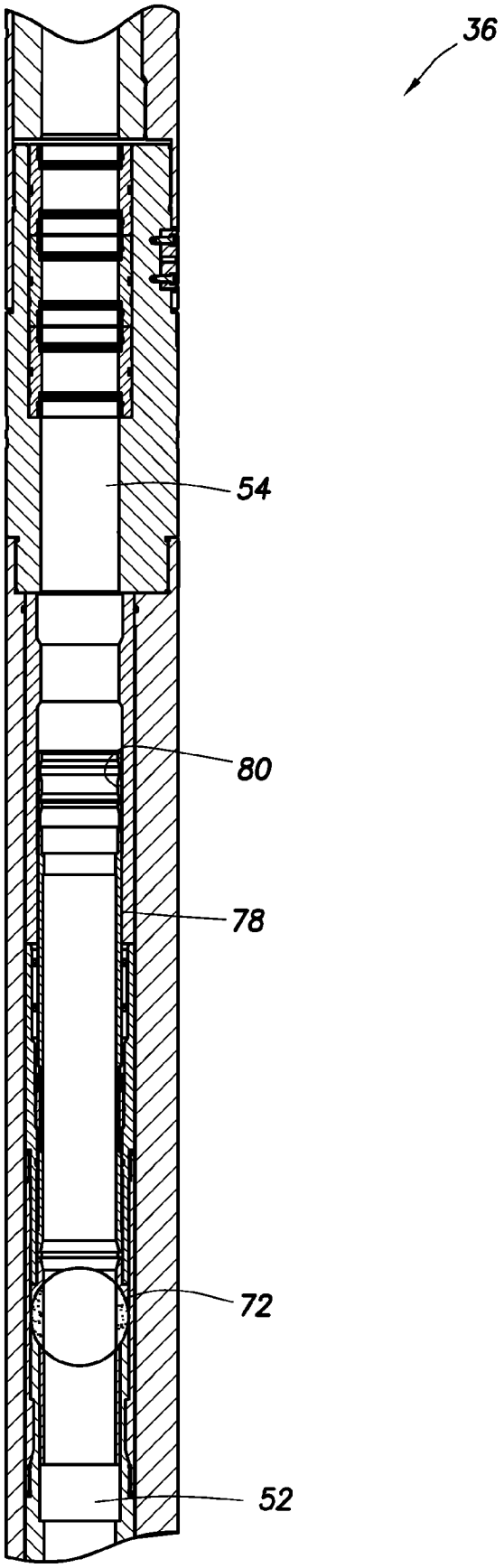

Referring additionally now to FIG. 9, another example of the flow control device 36 is representatively illustrated. In this example, the flow control device 36 comprises a ball valve, with the barrier 72 being a rotatable ball which selectively permits and prevents fluid communication between the passages 52, 54.

An actuation sleeve 78 of the flow control device 36 has a latch profile 80 formed therein. Collets or keys (not shown) on the lower end of the tubular string 24 can engage the profile 80 and shift the sleeve 78 downward to open the barrier 72 and permit fluid communication between the passages 52, 54. The barrier 72 can be closed by shifting the sleeve 78 upward, for example, by withdrawing the tubular string 24 (or another tool, such as a shifting tool, etc.) from the passage 54.

The flow control device 36 of FIG. 9 may be similar to a Model IB isolation valve marketed by Halliburton Energy Services, Inc. Other types of flow control devices which may be used include (but are not limited to) flapper valves, dissolvable plugs (such as the MIRAGE™ plug marketed by Halliburton Energy Services, Inc.), swellable materials, etc. Any type of flow control device may be used, in keeping with the scope of this disclosure.

Figure 10:
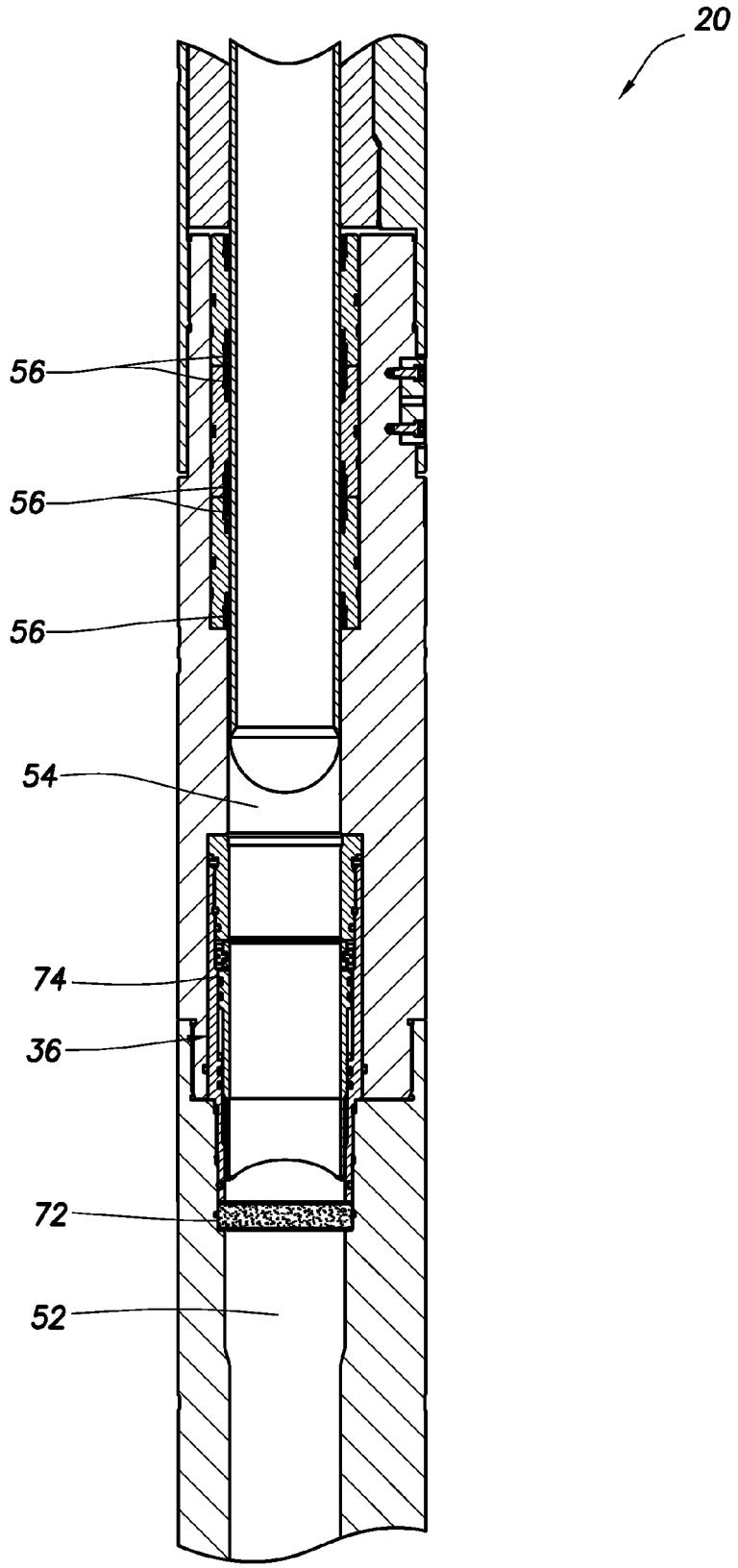

Referring additionally now to FIG. 10, another configuration of the flow control device 36 is representatively illustrated. This configuration is similar in some respects to the configuration of FIGS. 4 & 5.

The FIG. 10 flow control device 36 can be actuated to open the barrier 72 by application of increased pressure to the passage 54 above the barrier. When the pressure in the passage 54 has been increased to a predetermined level, the piston 74 will displace to pierce the barrier 72 and cause it to disperse, dissolve, disintegrate or otherwise degrade. The barrier 72 can also be pierced by the tubular string 24.

Note that, in the various examples described above, the flow control device 36 is not necessarily positioned just below the seals 56, but could be positioned elsewhere, if desired. For example, the flow control device 36 could be positioned above the seals 56, in a latch mechanism of the deflector 48, etc.

The tubular string 24 could include a latch or other device to engage and operate the flow control device 36. Alternatively, the latch or other device could be separately conveyed through the tubular string 24 to the flow control device 36 to open the flow control device.

It may now be fully appreciated that this disclosure provides significant improvements to the art of constructing wellbore junctions. The tubular string 24 can be inserted through the deflector 48 to open the flow control device 36 and thereby provide fluid communication between the passage 52 below the flow control device and the interior of the wellbore junction assembly 20.

The above disclosure describes a method of installing a wellbore junction assembly 20 in a well. In one example, the method can include inserting a first tubular string 24 through a deflector 48, and opening a flow control device 36 in response to the inserting.

The method may also include sealingly engaging the first tubular string 24 after inserting the first tubular string 24 into the deflector 48 and prior to opening the flow control device 36.

Opening the flow control device 36 may include breaking a frangible barrier 72, cutting through a barrier 72, and/or rotating a barrier 72.

The method can include deflecting a second tubular string 26 laterally off of the deflector 48. One end 28 of a tubular string connector 22 may be connected to the first and second tubular strings 24, 26.

A well system 10 is also described above. In one example, the well system 10 can include a deflector 48 positioned at an intersection between first, second and third wellbore sections 14, 16, 18, and a tubular string connector 22 having first and second tubular strings 24, 26 connected to an end 28 thereof. The first tubular string 24 is received in the deflector 48 and engaged with a flow control device 36 positioned in the first wellbore section 16, and the second tubular string 26 being received in the second wellbore section 18.

The first tubular string 24 may extend through the flow control device 36. The flow control device 36 may open in response to insertion of the first tubular string 24 therein.

The well system 10 can also include at least one seal 56 which sealingly engages the first tubular string 24.

The flow control device 36 may comprise a frangible barrier 72. The flow control device 36 may comprise a barrier 72 which opens in response to insertion of the first tubular string 24 through the deflector 48.

The flow control device 36 may operate in response to pressure in the first tubular string 24.

A method of installing a wellbore junction assembly 20 in a well is also described above. In one example, the method can include inserting a first tubular string 24 into a deflector 48 positioned at a wellbore intersection, then sealingly engaging the first tubular string 24, and then opening a flow control device 36 in response to the inserting.

The sealingly engaging step may include providing sealed fluid communication between the tubular string 24 and a flow passage 54 extending through the deflector 48.

It is to be understood that the various examples described above may be utilized in various orientations, such as inclined, inverted, horizontal, vertical, etc., and in various configurations, without departing from the principles of this disclosure. The embodiments illustrated in the drawings are depicted and described merely as examples of useful applications of the principles of the disclosure, which are not limited to any specific details of these embodiments.

In the above description of the representative examples, directional terms (such as "above," "top," "below," "bottom," "upper," "lower," etc.) are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore, whether the wellbore is horizontal, vertical, inclined, deviated, etc. However, it should be clearly understood that the scope of this disclosure is not limited to any particular directions described herein.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of this disclosure. Accordingly, the foregoing detailed description is to be clearly understood as being given by way of illustration and example only, the spirit and scope of the invention being limited solely by the appended claims and their equivalents.

What is claimed is:

1. A method of installing a wellbore junction assembly in a well, the method comprising:

inserting a first tubular string into a deflector;

sealingly engaging the first tubular string within the deflector; and opening a flow control device positioned below the deflector with the first tubular string in response to the inserting.

2. The method of claim 1, wherein the sealingly engaging the first tubular string with a seal is after the inserting the first tubular string into the deflector and prior to opening the flow control device.

3. The method of claim 1, wherein opening the flow control device further comprises breaking a frangible barrier.

4. The method of claim 1, wherein opening the flow control device further comprises cutting through a barrier.

5. The method of claim 1, wherein opening the flow control device further comprises rotating a barrier.

6. The method of claim 1, further comprising deflecting a second tubular string laterally off of the deflector.

7. The method of claim 6, wherein one end of a tubular string connector is connected to the first and second tubular strings.

8. A well system, comprising:

a deflector positioned at an intersection between first, second and third wellbore sections;

a tubular string connector having first and second tubular strings connected to an end thereof, the first tubular string being received in the deflector, sealingly engaged with a seal in the deflector, and operatively engaged with a flow control device positioned in the first wellbore section and below the deflector, and the second tubular string being received in the second wellbore section; and wherein the flow control device is configured to be opened by the first tubular string in response to insertion of the first tubular string therein.

9. The well system of claim 8, wherein the first tubular string extends through the flow control device.

10. The well system of claim 8, wherein the flow control device comprises a frangible barrier.

11. The well system of claim 8, wherein the flow control device comprises a barrier which opens in response to insertion of the first tubular string through the deflector.

12. The well system of claim 8, wherein the flow control device operates in response to pressure in the first tubular string.

13. A method of installing a wellbore junction assembly in a well, the method comprising:

inserting a first tubular string into a deflector positioned at a wellbore intersection;

then sealingly engaging the first tubular string within the deflector; and then opening a flow control device positioned below the deflector with the first tubular string in response to the inserting.

14. The method of claim 13, wherein sealingly engaging further comprises providing sealed fluid communication between the tubular string and a flow passage extending through the deflector.

15. The method of claim 13, wherein opening the flow control device further comprises breaking a frangible barrier.

16. The method of claim 13, wherein opening the flow control device further comprises cutting through a barrier.

17. The method of claim 13, wherein opening the flow control device further comprises rotating a barrier.

18. The method of claim 13, further comprising deflecting a second tubular string laterally off of the deflector.

* * * * *